US012305896B2

(12) United States Patent
Onaka et al.

(10) Patent No.: US 12,305,896 B2
(45) Date of Patent: May 20, 2025

(54) HEAT EXCHANGER AND REFRIGERATION CYCLE APPARATUS

(71) Applicant: Mitsubishi Electric Corporation, Tokyo (JP)

(72) Inventors: Yoji Onaka, Tokyo (JP); Takashi Matsumoto, Tokyo (JP); Takamasa Uemura, Tokyo (JP); Yohei Kato, Tokyo (JP); Norihiro Yoneda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 916 days.

(21) Appl. No.: 17/426,126

(22) PCT Filed: Mar. 5, 2019

(86) PCT No.: PCT/JP2019/008506

§ 371 (c)(1),
(2) Date: Jul. 28, 2021

(87) PCT Pub. No.: WO2020/178965

PCT Pub. Date: Sep. 10, 2020

(65) Prior Publication Data

US 2022/0099343 A1 Mar. 31, 2022

(51) Int. Cl.
*F25B 39/02* (2006.01)
*F28D 1/047* (2006.01)
(Continued)

(52) U.S. Cl.
CPC ..... *F25B 39/02* (2013.01); *F28D 1/047* (2013.01); *F28D 1/053* (2013.01); *F28F 9/02* (2013.01); *F28F 2210/02* (2013.01)

(58) Field of Classification Search
CPC ... F25B 39/02; F28D 1/047; F28F 9/02; F28F 2210/02
(Continued)

(56) References Cited

U.S. PATENT DOCUMENTS

2006/0048928 A1 3/2006 Maezawa et al.
2016/0341453 A1* 11/2016 Yamashita ..... F28F 13/12
2020/0300515 A1 9/2020 Sun et al.

FOREIGN PATENT DOCUMENTS

CN 104913548 A 9/2015
GB 2542312 A 3/2017
(Continued)

OTHER PUBLICATIONS

Extended European Search Report dated Feb. 3, 2022, issued in corresponding European patent 1 application No. 19918474.8.
(Continued)

*Primary Examiner* — Joel M Attey
(74) *Attorney, Agent, or Firm* — XSENSUS LLP

(57) ABSTRACT

A heat exchanger includes flat pipes and a gas header. The gas header longitudinally extends in a Y-direction such that refrigerant flows in the Y-direction, the flat pipes are spaced from each other in the Y-direction, joints inserted in the gas header in an X-direction are disposed at respective ends of the flat pipes, and gaps between the joints include a narrow gap and a wide gap, where the X-direction and the Y-direction are directions perpendicular to each other in a space.

10 Claims, 14 Drawing Sheets

(51) Int. Cl.
*F28D 1/053* (2006.01)
*F28F 9/02* (2006.01)

(58) Field of Classification Search
USPC ..... 165/100
See application file for complete search history.

(56) References Cited

FOREIGN PATENT DOCUMENTS

| | | | |
|---|---|---|---|
| JP | 2010-107068 | A | 5/2010 |
| JP | 2010-139113 | A | 6/2010 |
| JP | 2013-204913 | A | 10/2013 |
| JP | 2014-122770 | A | 7/2014 |
| JP | 2015-52444 | A | 3/2015 |
| WO | 2004/025207 | A1 | 3/2004 |
| WO | 2015/140886 | A1 | 9/2015 |
| WO | 2016/009565 | A1 | 1/2016 |
| WO | 2018/225252 | A1 | 12/2018 |

OTHER PUBLICATIONS

Office Action issued on Jun. 1, 2022, in corresponding Chinese patent Application No. 201980092865.6, 10 pages.
International Search Report and Written Opinion mailed on May 21, 2019, received for PCT Application PCT/JP2019/008506, Filed on Mar. 5, 2019, 13 pages including English Translation.

* cited by examiner

Comparative Example

EQUALLY SPACED ARRANGEMENT

PROXIMATE ARRANGEMENT (EMBODIMENT 1)

HEAT EXCHANGER AND REFRIGERATION CYCLE APPARATUS

CROSS-REFERENCE TO RELATED APPLICATION

The present application is based on PCT filing PCT/JP2019/008506, filed Mar. 5, 2019, the entire contents of which are incorporated herein by reference.

TECHNICAL FIELD

The present disclosure relates to a heat exchanger that includes flat pipes and a gas header, and a refrigeration cycle apparatus.

BACKGROUND ART

As for a heat exchanger that serves as an evaporator of an existing air-conditioning apparatus, two-phase gas-liquid refrigerant, which is a mixture of gas refrigerant and liquid refrigerant, flows into the heat exchanger, and a refrigerant distributor distributes the refrigerant to heat transfer pipes. In the heat transfer pipes, the refrigerant removes heat from air and turns into gas-rich refrigerant or single-phase gas refrigerant. Subsequently, the refrigerant flows into and is collected in a gas header, and the collected refrigerant flows out from the evaporator to the outside via a refrigerant pipe.

The diameter of each heat transfer pipe used in the heat exchanger has been decreased, and a multipath structure has been developed to adapt an improvement in energy consumption performance and a decrease in the amount of the refrigerant that has been recently achieved. In many cases, the heat transfer pipe is not a known circular pipe but a flat pipe that has a small-diameter flow path accordingly.

In the case where the flat pipe is used, it is necessary for the flat pipe to be inserted in the gas header to ensure manufacturing performance such as brazing performance at a joint between the flat pipe and the gas header. The flat pipe that is inserted in the gas header has a problem in that when the collected refrigerant passes through the inserted portion of the flat pipe in the gas header, a pressure loss increases due to the expansion or shrinkage of a refrigerant flow path, and energy efficiency decreases.

A method to reduce the pressure loss in the gas header involves providing a bypass flow path (see Patent Literature 1).

CITATION LIST

Patent Literature

Patent Literature 1: Japanese Unexamined Patent Application Publication No. 2014-122770

SUMMARY OF INVENTION

Technical Problem

However, the technique disclosed in Patent Literature 1 has a problem in that the size of the gas header increases due to the provided bypass flow path, and an area in which the heat exchanger is mounted decreases accordingly. In addition, there is a problem that manufacturing costs increase due to the provided bypass flow path.

The present disclosure has been made to solve the problems described above, and it is an object of the present disclosure to provide a heat exchanger that has a simple structure and that enables the pressure loss of refrigerant to be reduced, and a refrigeration cycle apparatus.

Solution to Problem

A heat exchanger according to an embodiment of the present disclosure includes a plurality of flat pipes in which two-phase gas-liquid refrigerant flows and turns into gas refrigerant by being heated from a location outside the plurality of flat pipes, and a gas header in which the gas refrigerant flowing out from the plurality of flat pipes is collected. The gas header is connected to first end portions of the plurality of flat pipes. The gas header longitudinally extends in a Y-direction such that the refrigerant flows in the Y-direction, the plurality of flat pipes are spaced from each other in the Y-direction, a plurality of joints inserted in the gas header in an X-direction are disposed at respective ends of the plurality of flat pipes, and gaps between the plurality of joints include a narrow gap and a wide gap, where the X-direction and the Y-direction are directions perpendicular to each other in a space.

A refrigeration cycle apparatus according to another embodiment of the present disclosure includes the heat exchanger described above.

Advantageous Effects of Invention

In the heat exchanger and the refrigeration cycle apparatus according to the embodiments of the present disclosure, the gaps between the joints include the narrow gap and the wide gap. Consequently, some of the joints of the flat pipes that are connected to the gas header are proximate to each other. At the proximate portions, the distance between the adjacent joints is short, the size of a space between the adjacent joints in the gas header is stable, and the space does not substantially expand or shrink in the direction of the flow of the refrigerant. For this reason, fluid resistance due to the expansion or shrinkage of the space decreases, vortex regions of the refrigerant can be reduced, the pressure loss of the refrigerant in the gas header can be reduced, and heat exchange performance can be improved. Accordingly, a simple structure is provided, and the pressure loss of the refrigerant can be reduced.

DESCRIPTION OF EMBODIMENTS

Figure 1:
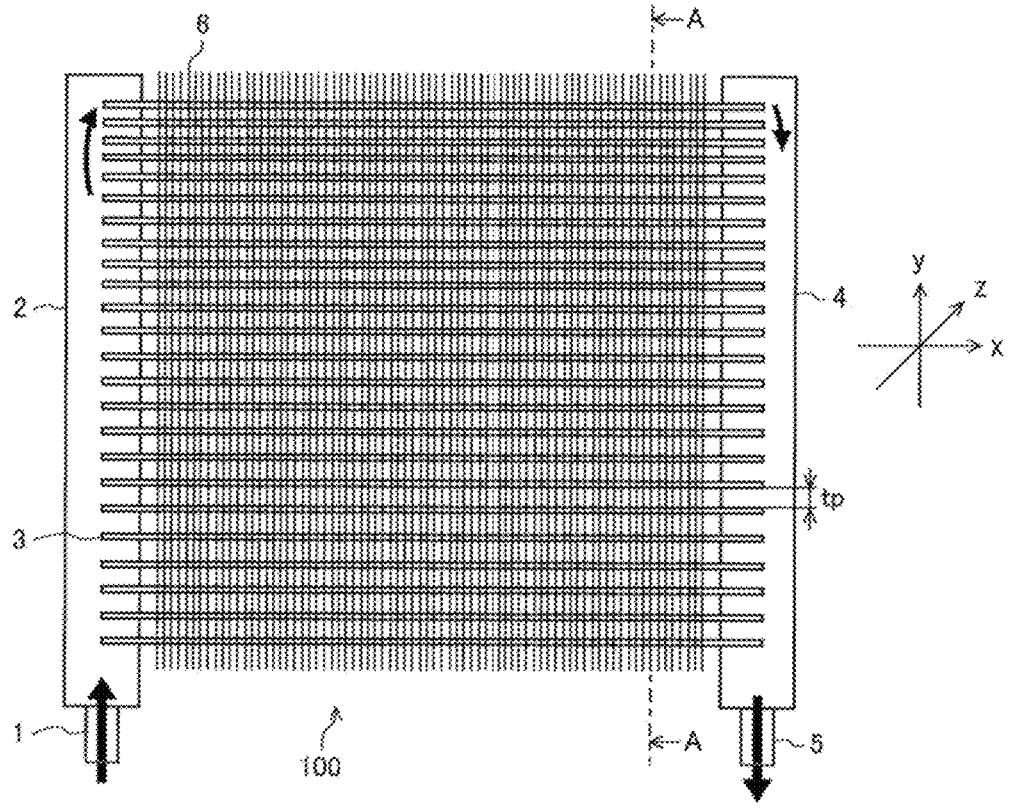
FIG. 1 schematically illustrates the structure of a heat exchanger according to Embodiment 1 of the present disclosure.

Embodiments of the present disclosure will hereinafter be described with reference to the drawings. In the drawings, the same or corresponding components are designated by the same reference signs. The same is true throughout the specification. In the perspective of visibility, hatching is appropriately omitted in sectional drawings. The forms of components are described by way of example in the specification and are not limited to the description.

Embodiment 1

<Structure of Heat Exchanger 100>

FIG. 1 schematically illustrates the structure of a heat exchanger 100 according to Embodiment 1 of the present disclosure. In FIG. 1, directions perpendicular to each other in a space are illustrated as an X-direction, a Y-direction, and a Z-direction. The Z-direction schematically illustrated in the figure extends upward and obliquely to the X-direction and the Y-direction.

As illustrated in FIG. 1, the heat exchanger 100 includes a gas header 4, flat pipes 3, fins 6, a refrigerant distributor 2, an inlet pipe 1, and an outlet pipe 5.

The gas header 4 is connected to first end portions of the flat pipes 3. In the gas header 4, gas refrigerant that flows out from the flat pipes 3 is collected. The gas header 4 longitudinally extends in the Y-direction such that the refrigerant flows in the Y-direction. The gas header 4 has a flow path a section of which has a circular shape.

The refrigerant distributor 2 is connected to second end portions of the flat pipes 3, and the second end portions are not connected to the gas header 4. The refrigerant distributor 2 distributes two-phase gas-liquid refrigerant to the flat pipes 3.

The fins 6 are connected to the flat pipes 3. The fins 6 described herein are not limited by the kinds of fins such as a plate fin and a corrugated fin.

In the flat pipes 3, the two-phase gas-liquid refrigerant flows and turns into the gas refrigerant by being heated from a location outside the flat pipes. The flat pipes 3 linearly extend in the X-direction. The flat pipes 3 are spaced from each other in the Y-direction. The respective ends of the flat pipes 3 have joints. The joints serve to allow the flat pipes 3 to be inserted in the gas header 4 in the X-direction. Gaps between the joints include narrow gaps and wide gaps. The fins 6 are spaced from each other in the X-direction and are disposed on the flat pipes 3. The fins 6 are joined to outer surfaces of the flat pipes 3.

At least the single outlet pipe 5 is connected to an end portion of the gas header 4. At least the single inlet pipe 1 is connected to an end portion of the refrigerant distributor 2. The position or number of the outlet pipe 5 or the inlet pipe 1 for the refrigerant is not particularly limited.

Figure 2:
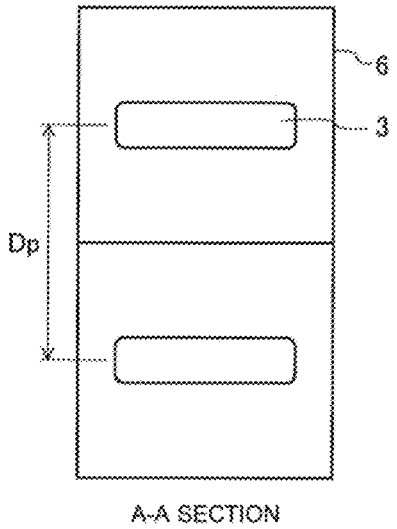
FIG. 2 illustrates joints between two flat pipes and a gas header according to Embodiment 1 of the present disclosure taken along line A-A in FIG. 1.

FIG. 2 illustrates joints between two flat pipes 3 and the gas header 4 according to Embodiment 1 of the present disclosure taken along line A-A in FIG. 1. In FIG. 2, Dp represents the step pitch of the flat pipes 3 and is the distance between the centers of minor axes of the adjacent flat pipes 3.

<Flow of Refrigerant in Heat Exchanger 100>

Arrows in FIG. 1 represent the flow of the refrigerant when the heat exchanger 100 functions as an evaporator. The two-phase gas-liquid refrigerant flows into the refrigerant distributor 2 via the inlet pipe 1. After the refrigerant flows into the refrigerant distributor 2, the two-phase gas-liquid refrigerant is distributed to each flat pipe 3 that is connected to the refrigerant distributor 2 in ascending order of the distance from the inlet pipe 1 to the flat pipe 3. Heat is exchanged between the two-phase gas-liquid refrigerant that is distributed to the flat pipes 3 and ambient air with the fins 6 interposed therebetween, and the two-phase gas-liquid refrigerant turns into gas-rich refrigerant or gas refrigerant and flows into the gas header 4. In the gas header 4, the refrigerant from the flat pipes 3 is collected. The refrigerant passes through the outlet pipe 5 from the gas header 4 and flows out from the heat exchanger 100.

As illustrated in FIG. 1, the flat pipes 3 are connected to the gas header 4 such that the distances between adjacent flat pipes 3 include a short distance and a long distance. This enables fluid resistance against the flow of the refrigerant in the gas header 4 to be decreased and enables the pressure loss of the refrigerant in the gas header 4 to be reduced. Each of the distances between adjacent flat pipes 3 illustrated in FIG. 1 is referred to as tp. In this case, the shortest distance in the distances between adjacent flat pipes 3 satisfies tp<Dp. The longest distance in the distances between adjacent flat pipes 3 satisfies tp>2×Dp.

That is, the length of the narrowest gap is referred to as tp1, the length of the widest gap is referred to as tp2, and the step pitch of the flat pipes 3 is referred to as Dp. In this case, the gaps between the joints at which the flat pipes 3 are connected to the gas header 4 satisfy tp1<Dp and tp2>2×Dp.

<Mechanism of Pressure Loss Reduction of Refrigerant in Gas Header 4 According to Embodiment 1>

Figure 3:
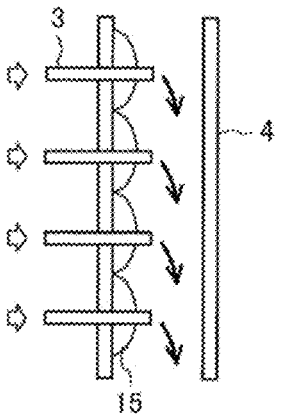
FIG. 3 illustrates the flow of refrigerant at joints between flat pipes that are equally spaced from each other in a comparative example and the gas header.
Figure 4:
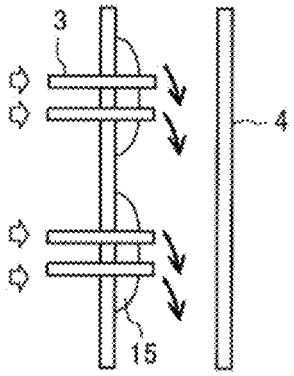
FIG. 4 illustrates the flow of refrigerant at joints between flat pipes that are proximate to each other and the gas header according to Embodiment 1 of the present disclosure.

FIG. 3 illustrates the flow of refrigerant at joints between flat pipes 3 that are equally spaced from each other in a comparative example and the gas header 4. The structure in the comparative example in FIG. 3 is compared with the structure according to Embodiment 1. FIG. 4 illustrates the flow of the refrigerant at joints between flat pipes 3 that are proximate to each other and the gas header 4 according to Embodiment 1 of the present disclosure. A mechanism for reducing the pressure loss that the inventors have found in experiment and analysis will now be described with reference to FIG. 3 and FIG. 4. Arrows in FIG. 3 and FIG. 4 represent the flow of the refrigerant. Outline arrows represent the direction in which the refrigerant flows into, and black arrows represent the direction in which the refrigerant flows out. Hatching semicircles in FIG. 3 and FIG. 4 represent front and rear vortex regions 15 of the flat pipes 3.

In the case of the equally spaced arrangement in the comparative example, the flow of the refrigerant continuously increases or decreases upstream and downstream of the flat pipes 3. Consequently, the vortex regions 15 are continuous with the flat pipes 3, and the pressure loss of the refrigerant increases.

In the case of the proximate arrangement according to Embodiment 1, the distance between the flat pipes 3 that are proximate to each other is short. For this reason, the flow of the refrigerant does not substantially increase or decrease but stabilizes in proximate spaces. Consequently, the fluid resistance due to the increase or decrease in the flow of the refrigerant decreases, and the vortex regions 15 can be reduced. The inventors have found that the pressure loss of the refrigerant in the gas header 4 can be reduced by reducing the vortex regions 15 in this way. Accordingly, in the case where the gaps between the joints of adjacent flat pipes 3 include the narrow gaps and the wide gaps, the pressure loss of the refrigerant can be smaller than that in the case where the joints of adjacent flat pipes 3 are equally spaced from each other.

In the experiment and calculation, the inventors have found that the pressure loss due to the increase or decrease in the flow of the refrigerant other than pressure loss due to frictional fluid resistance is about 50% or more of the pressure loss of the refrigerant in the gas header 4, although this depends on conditions in which the refrigerant flows into.

<Relationship Between Sectional Area Ai of Flow Path of Gas Header 4 and Area AL Blocked by Flat Pipe 3>

Figure 5:
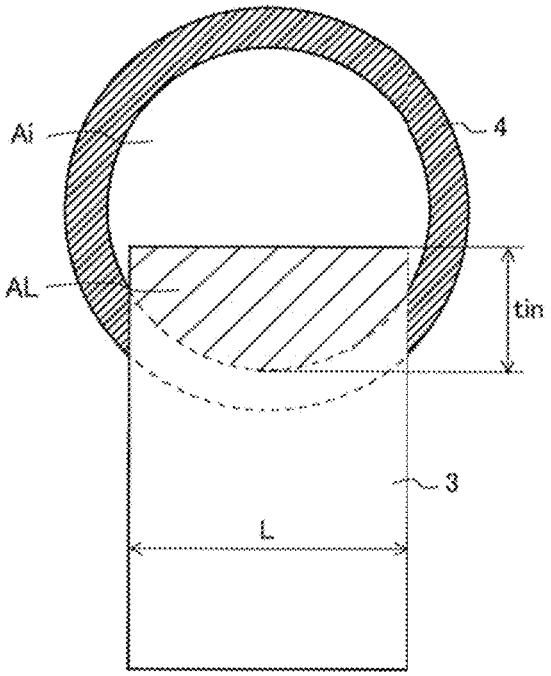
FIG. 5 illustrates a relationship between Ai and AL, where Ai is a sectional area of a flow path of the gas header, and AL is an area blocked by each flat pipe according to Embodiment 1 of the present disclosure.
Figure 6:
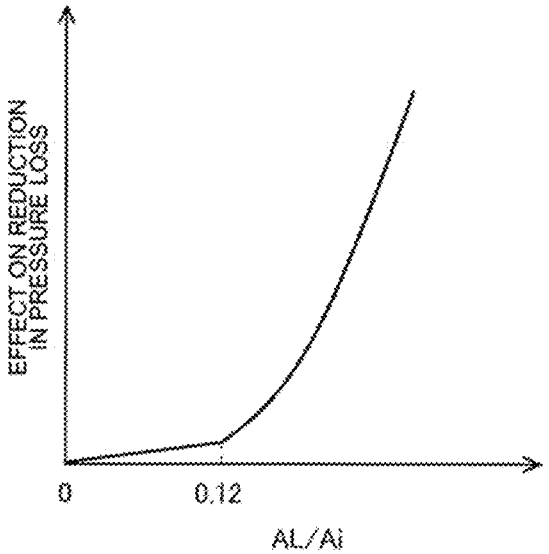
FIG. 6 illustrates an effect on a reduction in a pressure loss when the flat pipes according to Embodiment 1 of the present disclosure satisfy $AL/Ai \geq 0.12$.

FIG. 5 illustrates a relationship between Ai and AL, where Ai is a sectional area of the flow path of the gas header 4, and AL is an area blocked by each flat pipe 3 according to Embodiment 1 of the present disclosure. FIG. 6 illustrates an effect on a reduction in the pressure loss when the flat pipes 3 according to Embodiment 1 of the present disclosure satisfy AL/Ai≥0.12.

As illustrated in FIG. 5, the sectional area of the flow path of the gas header 4 is referred to as Ai. The area blocked by each flat pipe 3 is referred to as AL. As illustrated in FIG. 6, it has been found that when AL/Ai≥0.12 is satisfied, the effect on the reduction in the pressure loss of the refrigerant in the gas header 4 is particularly remarkable with the narrow gaps and the wide gaps being between the joints of adjacent flat pipes 3.

<Relationship Between Insertion Length tin of Flat Pipes 3 in Gas Header 4 and Distance tp Between Flat Pipes 3 for Narrow Gap>

Figure 7:
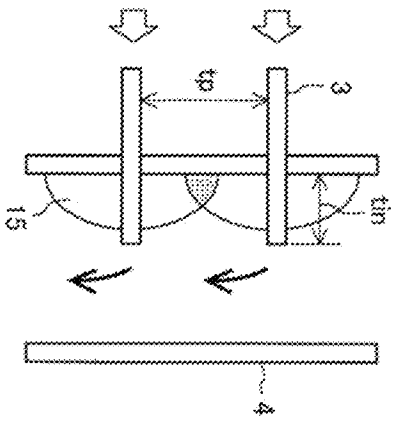
FIG. 7 illustrates a relationship between tin and tp, where tin is the insertion length of each flat pipe in the gas header, and tp is the distance between flat pipes for a narrow gap according to Embodiment 1 of the present disclosure.

FIG. 7 illustrates a relationship between tin and tp, where tin is the insertion length of each flat pipe 3 in the gas header 4, and tp is each of the distances between the flat pipes 3 for the narrow gaps according to Embodiment 1 of the present disclosure.

As illustrated in FIG. 7, the insertion length of each flat pipe 3 in the gas header 4 is referred to as tin. Each of the distances between adjacent flat pipes 3 when the distance is the short distance is referred to as tp. In this case, when tp<2.0×tin is satisfied, the vortex regions 15 between adjacent flat pipes 3 partly overlap.

That is, the insertion length of an end portion of each flat pipe 3 in the gas header 4 is referred to as tin, and the distance between the flat pipes 3 including the joints that form one of the narrow gaps is referred to as tp. In this case, the distance between two flat pipes 3 that are proximate to the narrowest gap in the gaps between the joints satisfies tp<2.0×tin.

<Relationship Between Insertion Length tin of Flat Pipe 3 in Gas Header 4 and Inner Diameter Di of Gas Header 4>

Figure 8:
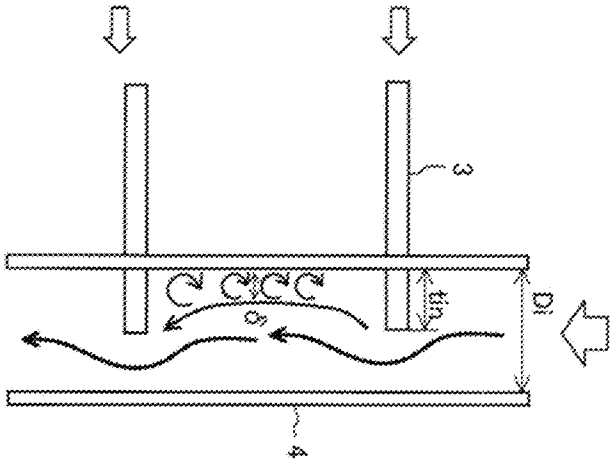
FIG. 8 illustrates the streamline of the refrigerant with vortex regions overlapping, where tin is the insertion length of each flat pipe in the gas header, and Di is the inner diameter of the gas header according to Embodiment 1 of the present disclosure.
Figure 9:
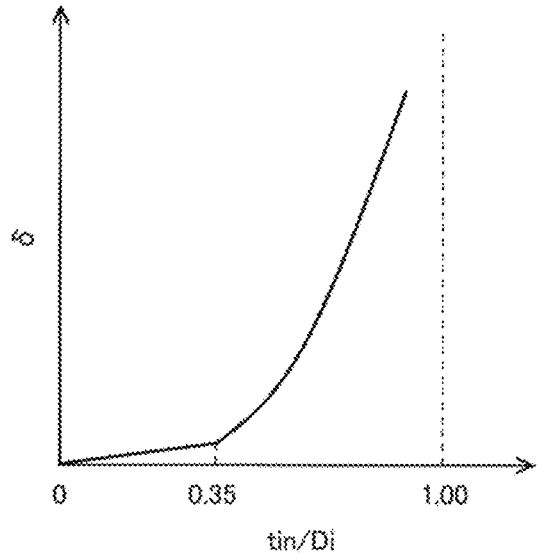
FIG. 9 illustrates vortex thickness δ according to Embodiment 1 of the present disclosure when $0.35 \leq tin/Di < 1.00$ is satisfied.

FIG. 8 illustrates the streamline of the refrigerant with the vortex regions 15 overlapping, where tin is the insertion length of each flat pipe 3 in the gas header 4, and Di is the inner diameter of the gas header 4 according to Embodiment 1 of the present disclosure. FIG. 9 illustrates vortex thickness δ according to Embodiment 1 of the present disclosure when 0.35≤tin/Di<1.00 is satisfied.

As illustrated in FIG. 8, the vortex regions 15 illustrated by open circle arrows in the figure overlap where a vortex thickness δ is illustrated. In the case where the vortex regions 15 overlap, the flow of the refrigerant does not increase or decrease due to the vortex thickness δ. Consequently, the pressure loss of the refrigerant due to the increase or decrease in the flow of the refrigerant can be reduced due to the vortex thickness δ. In the experiment and analysis, the inventors have found that the vortex thickness δ rapidly increases in a region that satisfies 0.35≤tin/Di<1.00 as illustrated in FIG. 9. The inventors have also found that the value of the vortex thickness δ is small in a region that satisfies 0≤tin/Di<0.35. Accordingly, when 0.35≤tin/Di<1.00 is satisfied, the pressure loss of the refrigerant in the gas header 4 is greatly reduced.

That is, the insertion length of each flat pipe 3 in the gas header 4 is referred to as tin. The inner diameter of the gas header 4 in a section perpendicular to a refrigerant flow path is referred to as Di. In this case, 0.35≤tin/Di<1.00 is satisfied.

Others

The kind of the refrigerant is not limited. However, olefin refrigerant such as HFO1234yf or HFO1234ze(E), or low-pressure refrigerant the saturation pressure of which is lower than that of R32 refrigerant such as propane refrigerant or dimethyl ether refrigerant (DME) are more effectively used as the refrigerant that flows in the gas header 4. Naturally, these are not limited to pure refrigerant. The refrigerant that flows in the gas header 4 may be a mixture of at least one of olefin refrigerant such as HFO1234yf or HFO1234ze(E), propane refrigerant, or dimethyl ether refrigerant (DME).

Effects of Embodiment 1

According to Embodiment 1, the heat exchanger 100 includes the flat pipes 3 in which the two-phase gas-liquid refrigerant flows and turns into the gas refrigerant by being heated from a location outside the flat pipes 3. The heat exchanger 100 includes the gas header 4 in which the gas refrigerant that flows out from the flat pipes 3 is collected, and the gas header is connected to the first end portions of the flat pipes 3. As for the heat exchanger 100, directions perpendicular to each other in a space are referred to as the X-direction and the Y-direction. The gas header 4 longitudinally extends in the Y-direction such that the refrigerant flows in the Y-direction. The flat pipes 3 are spaced from each other in the Y-direction. The joints that are inserted in the gas header 4 in the X-direction are disposed at the respective ends of the flat pipes 3. The gaps between the joints include the narrow gaps and the wide gaps.

With this structure, some of the joints of the flat pipes 3 that are connected to the gas header 4 are proximate to each other. At the proximate portions, the distance between the adjacent joints is short, the size of the space between the adjacent joints in the gas header 4 is stable, and the space does not substantially expand or shrink in the direction of the flow of the refrigerant. For this reason, the fluid resistance due to the expansion or shrinkage of the space decreases, the vortex regions 15 of the refrigerant can be reduced, the pressure loss of the refrigerant in the gas header 4 can be reduced, and heat exchange performance can be improved. Accordingly, a simple structure is provided, and the pressure loss of the refrigerant can be reduced.

According to Embodiment 1, the heat exchanger 100 includes the fins 6 that are connected to the flat pipes 3. As for the gaps between the joints, the length of the narrowest gap is referred to as tp1, the length of the widest gap is referred to as tp2, and the step pitch of the flat pipes 3 is referred to as Dp. In this case, $tp1<Dp$ and $tp2>2\times Dp$ are satisfied.

With this structure, the fluid resistance due to the expansion or shrinkage of the space in the direction of the flow of the refrigerant further decreases, the vortex regions 15 of the refrigerant can be reduced, the pressure loss of the refrigerant in the gas header 4 can be further reduced, and the heat exchange performance can be further improved.

According to Embodiment 1, the flat pipes 3 linearly extend in the X-direction.

With this structure, the flat pipes 3 can be readily manufactured, the heat exchanger 100 has a simple structure, and the pressure loss of the refrigerant can be reduced.

According to Embodiment 1, the insertion length of the end portion of each flat pipe 3 in the gas header 4 is referred to as tin, and the distance between the flat pipes 3 including the joints that form the narrow gap is referred to as tp. In this case, the distance between the two flat pipes 3 that are proximate to the narrowest gap in the gaps between the joints satisfies $tp<2.0\times tin$.

With this structure, the vortex regions 15 between the joints of the adjacent flat pipes 3 partly overlap. In the case where the vortex regions 15 thus overlap, the space does not expand or shrink in direction of the flow of the refrigerant due to the vortex thickness, and the size of the space is regarded as being stable, and the pressure loss of the refrigerant can be reduced accordingly without being affected by the expansion or shrinkage of the space.

According to Embodiment 1, the insertion length of the end portion of each flat pipe 3 in the gas header 4 is referred to as tin, and the inner diameter of the gas header 4 in the section perpendicular to the refrigerant flow path is referred to as Di. In this case, $0.35\leq tin/Di<1.00$ is satisfied.

With this structure, the vortex thickness in the space greatly increases regarding the direction of the flow of the refrigerant, the space does not expand or shrink due to the vortex thickness, the size of the space is regarded as being stable, and the pressure loss of the refrigerant can be reduced accordingly without being affected by the expansion or shrinkage of the space.

According to Embodiment 1, the refrigerant that flows in the gas header 4 is olefin refrigerant, propane refrigerant, or dimethyl ether refrigerant.

This feature enables the pressure loss of the refrigerant to be more effectively reduced because the refrigerant is low-pressure refrigerant the saturation pressure of which is lower than that of R32 refrigerant.

According to Embodiment 1, the refrigerant that flows in the gas header 4 is a mixture of at least one of olefin refrigerant, propane refrigerant, or dimethyl ether.

This feature enables the pressure loss of the refrigerant to be more effectively reduced because the refrigerant is low-pressure refrigerant the saturation pressure of which is lower than that of R32 refrigerant.

According to Embodiment 1, the heat exchanger 100 includes the refrigerant distributor 2 that is connected to the second end portions of the flat pipes 3 and that distributes the two-phase gas-liquid refrigerant to the flat pipes 3.

With this structure, the refrigerant distributor 2 can distribute the two-phase gas-liquid refrigerant to the flat pipes 3.

Embodiment 2

<Structure of Heat Exchanger 100>

Figure 10:
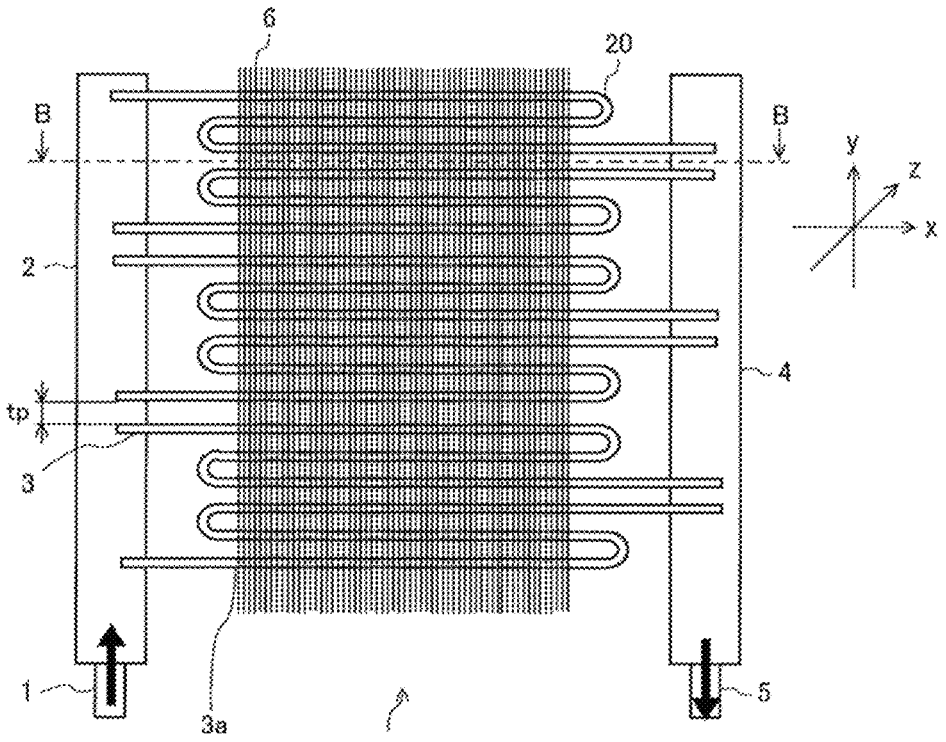
FIG. 10 schematically illustrates the structure of a heat exchanger according to Embodiment 2 of the present disclosure.

FIG. 10 schematically illustrates the structure of a heat exchanger 100 according to Embodiment 2 of the present disclosure. The same matters as those according to Embodiment 1 described above are omitted, and only features according to Embodiment 2 will be described.

As illustrated in FIG. 10, a line B-B is an imaginary center line, and two flat pipes 3 that are connected to the gas header 4 and that are proximate to each other are symmetrical about the line B-B. The two flat pipes 3 that are proximate to each other include folded portions 20 such that the end portions that are connected to the refrigerant distributor 2 are away from the line B-B.

Narrow gaps and wide gaps in the gaps between the joints alternate. The joints that form one of the narrow gaps are included in a group of the two flat pipes 3 of the flat pipes 3. The group of the two flat pipes 3 in which the joints form the narrow gap is symmetrical about the imaginary center line B-B that passes through the center of the group in the Y-direction. Heat exchange portions 3*a* of the flat pipes 3 other than the joints where the fins 6 are disposed are equally spaced from each other in the Y-direction. The two flat pipes 3 including the joints that form the narrow gap include the folded portions 20 that are obtained by folding the end portions that are connected to the refrigerant distributor 2 in the direction in which the end portions are away from the imaginary center line B-B.

With this structure, the two flat pipes 3 that are connected to the gas header 4 are proximate to each other, and the pressure loss of the refrigerant in the gas header 4 can be reduced.

<Section of Flow Path of Gas Header 4>

The section of the flow path of the gas header 4 described herein is circular. However, the section of the flow path of the gas header 4 is not limited thereto as described later.

Figure 11:
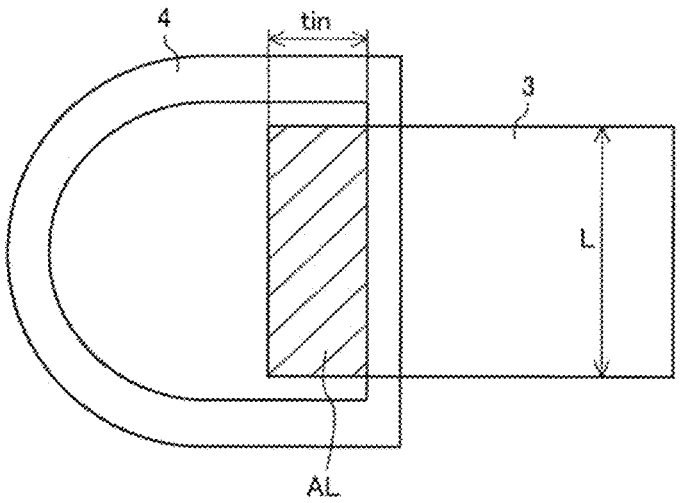
FIG. 11 illustrates another example of a section of the flow path of the gas header according to Embodiment 2 of the present disclosure.

FIG. 11 illustrates another example of the section of the flow path of the gas header 4 according to Embodiment 2 of the present disclosure. As illustrated in FIG. 11, the section of the flow path of the gas header 4 has a D-shape. In the case of the D-shaped section of the flow path, the joint between each flat pipe 3 and the gas header 4 is linear.

This structure is good because the minimum brazing area of each flat pipe 3 is readily ensured, and the brazing performance is improved. Also, in the case of the D-shape illustrated in FIG. 11 instead of a circular shape, the sectional area Ai of the flow path at a position at which there is no inserted flat pipe 3 is given as $Ai=(Di/2)2\times\pi$, where a representative, equivalent diameter is used as Di. The D-shape of the gas header 4 is representatively described herein. However, the gas header 4 is not limited by the shape.

<Structure of Heat Exchanger 100>

Figure 12:
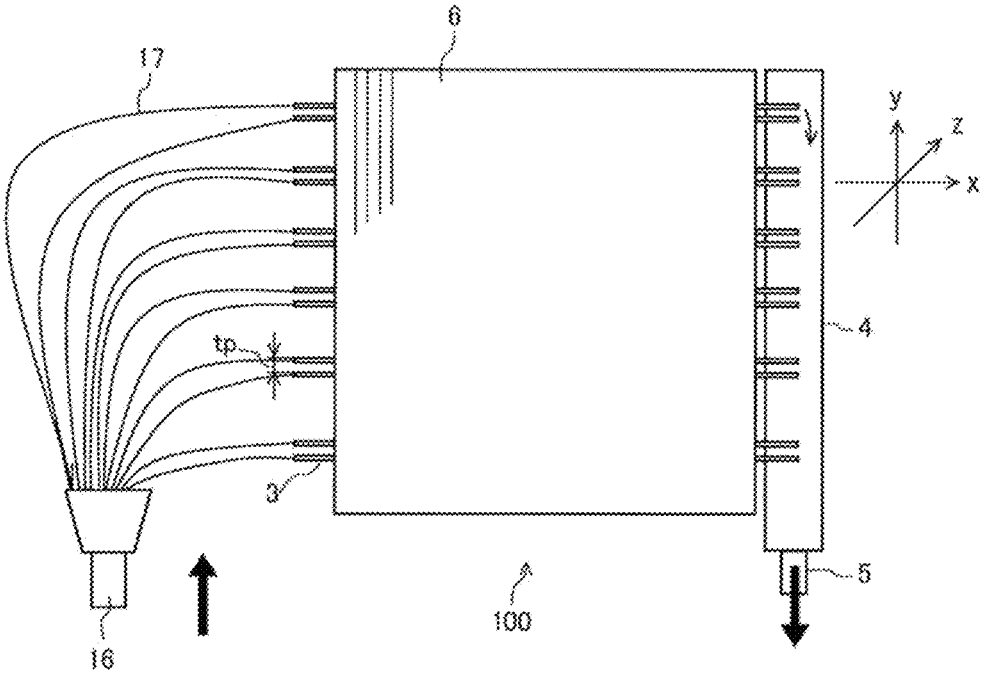
FIG. 12 illustrates another example of the structure of the heat exchanger according to Embodiment 2 of the present disclosure.

FIG. 12 schematically illustrates another example of the structure of the heat exchanger 100 according to Embodiment 2 of the present disclosure. The refrigerant distributor 2 may be a refrigerant distributor other than a header refrigerant distributor such as a collision refrigerant distributor that includes a distributor 16 and capillary tubes 17 as illustrated in FIG. 12. In addition, the kind of the refrigerant distributor 2 is not particularly limited.

Effects of Embodiment 2

According to Embodiment 2, the narrow gaps and the wide gaps in the gaps between the joints alternate.

With this structure, because of the joints that form the narrow gap, the vortex regions 15 between the joints that form the narrow gap partly overlap and smoothly expand in the Y-direction. The vortex regions 15 thus smoothly expand in the Y-direction. Consequently, the space does not expand or shrink in direction of the flow of the refrigerant due to the vortex thickness, and the size of the space is regarded as being stable, and the pressure loss of the refrigerant can be reduced accordingly without being affected by the expansion or shrinkage of the space.

According to Embodiment 2, the joints that form the narrow gap are included in the group of the two flat pipes 3 of the flat pipes 3.

With this structure, the group of the two flat pipes 3 enables the joints to form the narrow gap, the vortex regions 15 between the joints that form the narrow gap partly overlap and smoothly expand in the Y-direction.

According to Embodiment 2, the group of the two flat pipes 3 is symmetrical about the imaginary center line B-B that passes through the center of the group in the Y-direction.

With this structure, the sizes of the vortex regions 15 that smoothly expand in the Y-direction are stable, the space does not expand or shrink in direction of the flow of the refrigerant due to the vortex thickness of the vortex regions 15, the size of the space is regarded as being stable, and the pressure loss of the refrigerant can be reduced accordingly without being affected by the expansion or shrinkage of the space.

According to Embodiment 2, the heat exchange portions 3*a* of the flat pipes 3 other than the joints are equally spaced from each other in the Y-direction.

With this structure, the heat exchange portions 3*a* of the flat pipes 3 are equally spaced from each other in the Y-direction, the ventilation resistance of the entire heat exchanger can be reduced, non-uniformity of heat exchange of the flat pipes 3 can be reduced, and heat-exchange efficiency can be improved.

According to Embodiment 2, the two flat pipes 3 included in the group in which the joints form the narrow gap include the folded portions 20 that are obtained by folding the second end portions that are connected to the refrigerant distributor 2 in the direction in which the second end portions are away from the imaginary center line B-B.

With this structure, the length of the heat exchange portion 3*a* of each flat pipes 3 increases, and the heat-exchange efficiency can be improved.

Embodiment 3

<Structure of Heat Exchanger 100>

Figure 13:
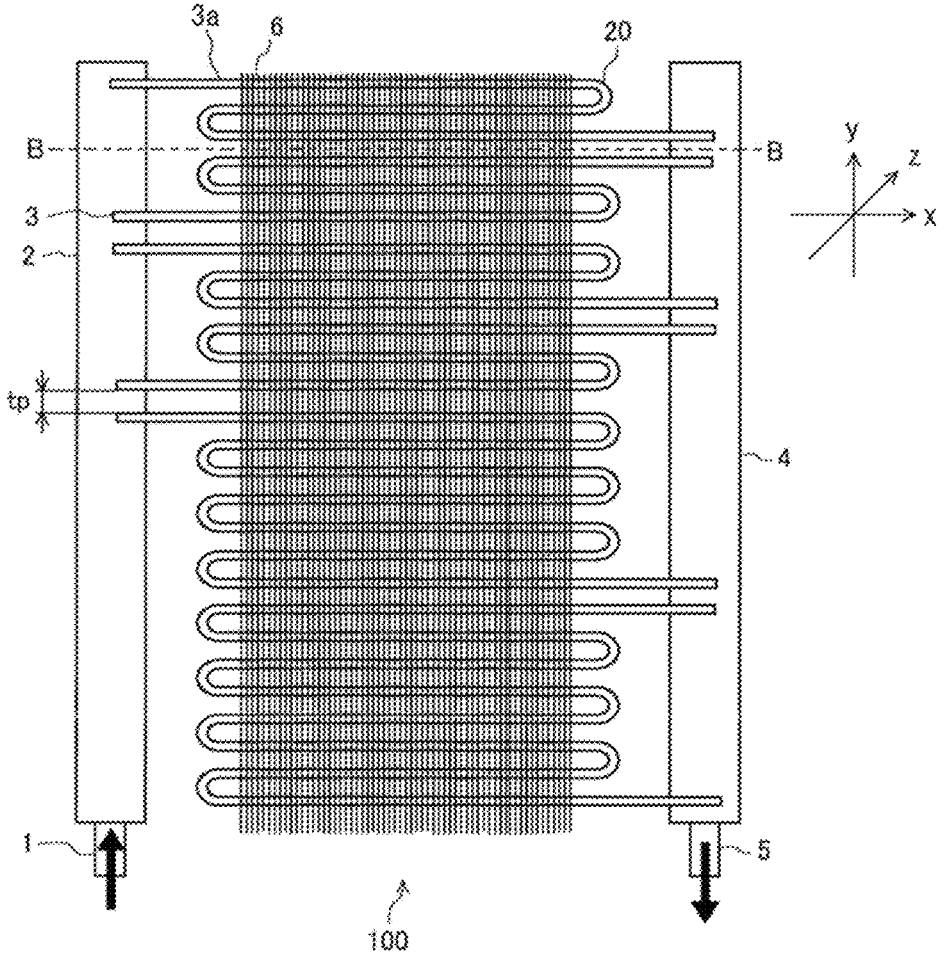
FIG. 13 schematically illustrates the structure of a heat exchanger according to Embodiment 3 of the present disclosure.

FIG. 13 schematically illustrates the structure of a heat exchanger 100 according to Embodiment 3 of the present disclosure. The same matters as those according to Embodiment 1 and Embodiment 2 described above are omitted, and only features according to Embodiment 3 will be described.

As illustrated in FIG. 13, a line B-B is an imaginary center line, and two flat pipes 3 including joints that are proximate to each other are symmetrical about the line B-B. The two flat pipes 3 including the joints that are proximate to each other include the folded portions 20 such that the end portions that are connected to the refrigerant distributor 2 are away from the line B-B.

The number of the folded portions 20 of each flat pipe 3 increases as the distance from the flat pipe 3 to the outlet pipe 5 decreases. That is, the number of the folded portions 20 of each flat pipe 3 increases as the distance from the flat pipe 3 to the outlet pipe 5 that serves as the outlet port of the gas header 4 decreases.

With this structure, the gas-rich refrigerant or gas refrigerant is collected in the gas header 4, the proximate arrangement of the flat pipes 3 enables the pressure loss of the refrigerant near the outlet pipe 5 at which the flow rate of the refrigerant increases to be reduced.

Effects of Embodiment 3

According to Embodiment 3, the number of the folded portions 20 of each flat pipe 3 increases as the distance from the flat pipe 3 to the outlet port in communication with the outlet pipe 5 of the gas header 4 decreases.

With this structure, the number of the folded portions 20 of each flat pipe 3 increases as the distance from the flat pipe 3 to the outlet port of the gas header 4 decreases. In the case where the outlet port faces downward in the Y-direction, the amount of liquid refrigerant that flows into each flat pipe 3 increases as the distance from the flat pipe 3 to the outlet port in communication with the outlet pipe 5 decreases because of the influence of the gravity. However, opportunities for heat exchange are proportional to the number of the folded portions 20 of the flat pipes 3, and the refrigerant turns into the gas-rich refrigerant or gas refrigerant. Accordingly, the heat-exchange efficiency of the heat exchanger 100 can be improved.

Embodiment 4

<Structure of Heat Exchanger 100>

Figure 14:
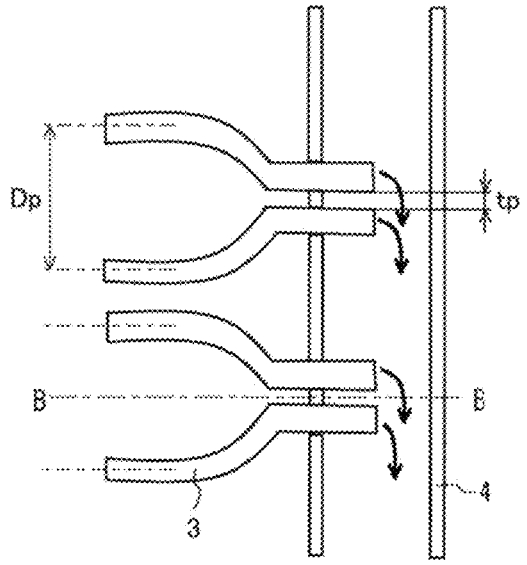
FIG. 14 is an enlarged view of bends of end portions of flat pipes according to Embodiment 4 of the present disclosure.

FIG. 14 is an enlarged view of bends of end portions of some of flat pipes 3 according to Embodiment 4 of the present disclosure. The same matters as those according to Embodiment 1, Embodiment 2, and Embodiment 3 described above are omitted, and only features according to Embodiment 4 will be described.

As illustrated in FIG. 14, the end portions of some of the flat pipes 3 that are connected to the gas header 4 are bent. Consequently, the adjacent flat pipes 3 are proximate to each other.

Joints are formed by bending the end portions of some of the flat pipes 3. A group symmetrical about an imaginary center line B-B includes two flat pipes 3. The end portions of the two flat pipes 3 included in the group are bent toward the imaginary center line B-B. The heat exchange portions 3*a* of the flat pipes 3 other than the joints where the fins 6 are disposed may be equally spaced from each other in the Y-direction.

This structure is good because the flat pipes 3 are not limited by a restriction on the dimensions of the fins 6 and can be proximate to each other, and the pressure loss of the refrigerant can be reduced. The step pitch of the heat exchange portions 3*a* of the flat pipes 3 is referred to as Dp. The distance between the joints of the adjacent flat pipes 3 for one of the narrow gaps satisfies tp<Dp.

Effects of Embodiment 4

According to Embodiment 4, the joints are formed by bending the end portions of some of the flat pipes 3.

With this structure, the flat pipes 3 can be readily manufactured merely by bending the end portions of the flat pipes 3 and have a simple structure, and the pressure loss of the refrigerant can be reduced.

According to Embodiment 4, the group symmetrical about the imaginary center line B-B includes the two flat pipes 3. The end portions of the two flat pipes 3 included in the group are connected to the gas header 4 and are bent toward the imaginary center line B-B.

With this structure, some of the joints of the flat pipes 3 that are connected to the gas header 4 can be proximate to each other.

Embodiment 5

<Structure of Heat Exchanger 100>

Figure 15:
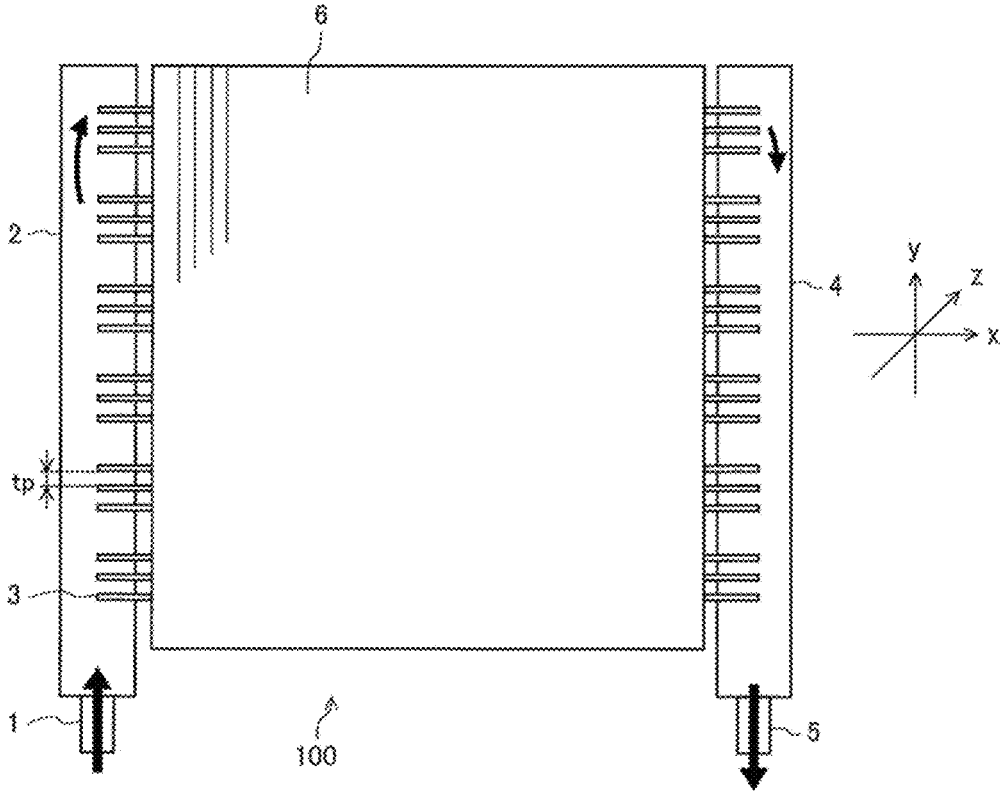
FIG. 15 schematically illustrates the structure of a heat exchanger according to Embodiment 5 of the present disclosure.
Figure 16:
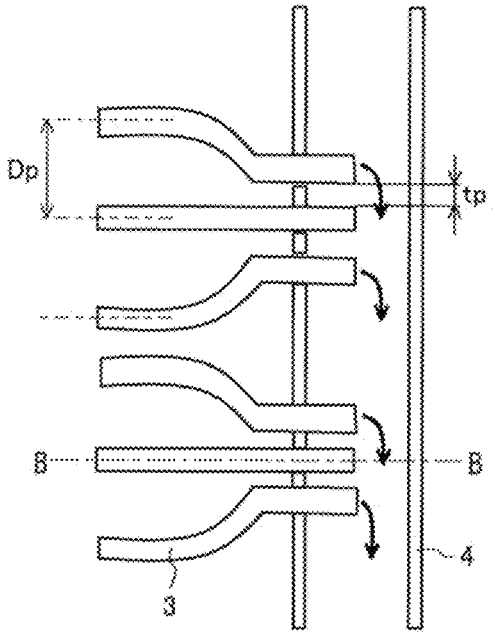
FIG. 16 is an enlarged view of bends of end portions of flat pipes according to Embodiment 5 of the present disclosure.

FIG. 15 schematically illustrates the structure of a heat exchanger 100 according to Embodiment 5 of the present disclosure. FIG. 16 is an enlarged view of bends of end portions of some of flat pipes 3 according to Embodiment 5 of the present disclosure. The same matters as those according to Embodiment 1, Embodiment 2, Embodiment 3, and Embodiment 4 described above are omitted, and only features according to Embodiment 5 will be described.

As illustrated in FIG. 15 and FIG. 16, a group symmetrical about an imaginary center line B-B includes three flat pipes 3. End portions of the outermost flat pipes 3 in the Y-direction in the group among the three flat pipes 3 included in the group are bent toward the imaginary center line B-B. The group symmetrical about the imaginary center line B-B may include 4 or more flat pipes 3.

Effects of Embodiment 5

According to Embodiment 5, the group symmetrical about the imaginary center line B-B includes three or more flat pipes 3. At least the end portions of the outermost flat pipes 3 in the Y-direction in the group among the three or more flat pipes 3 included in the group are bent toward the imaginary center line B-B.

With this structure, some of the joints of the flat pipes 3 that are connected to the gas header 4 can be proximate to each other.

Embodiment 6

<Structure of Heat Exchanger 100>

Figure 17:
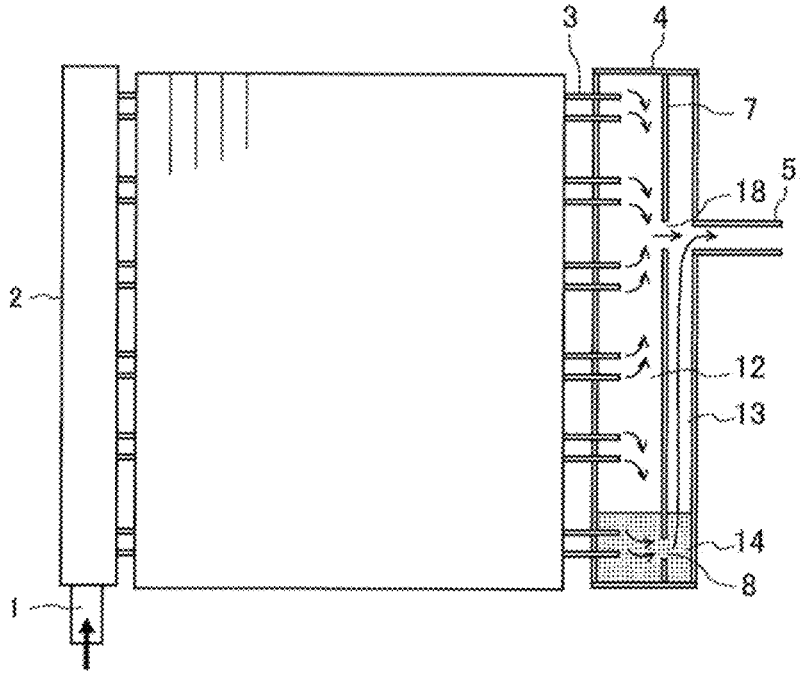
FIG. 17 schematically illustrates the structure of a heat exchanger according to Embodiment 6 of the present disclosure.

FIG. 17 schematically illustrates the structure of a heat exchanger 100 according to Embodiment 6 of the present disclosure. The same matters as those according to Embodiment 1, Embodiment 2, Embodiment 3, Embodiment 4, and Embodiment 5 described above are omitted, and only features according to Embodiment 6 will be described.

As illustrated in FIG. 17, a partition 7 is disposed in the gas header 4. The partition 7 has a first opening portion 18 and a second opening portion 8.

The partition 7 is between a refrigerant flow path on which the joints of the flat pipes 3 are inserted in the gas header 4 and a bypass flow path. The first opening portion 18 between the bypass flow path and the refrigerant flow path partly overlaps, in the X-direction, opening end portions of the flat pipes 3 that are inserted in the gas header 4. The second opening portion 8 between the bypass flow path and the refrigerant flow path overlaps, in the X-direction, a set of the joints that form one of the narrow gaps. The number of the second opening portion 8 may be plural.

This structure is good because a bypass for part of the refrigerant that passes through the joints of the flat pipes 3 can be made in the gas header 4, and the pressure loss of the refrigerant in the gas header 4 can be reduced. Even in the case where the bypass flow path is formed by the partition 7 in the gas header 4, the flat pipes 3 can be proximate to each other, and the pressure loss of the refrigerant can be reduced. This is good also in the case where the outlet pipe 5 is disposed on an upper portion because bypass flow of the refrigerant enables compressor oil that is stored in a bottom portion of the gas header 4 due to the gravity to return to a compressor 102 of a refrigeration cycle apparatus 101.

Effects of Embodiment 6

According to Embodiment 6, the gas header 4 contains the partition 7 and has the bypass flow path.

With this structure, the bypass flow path is not affected by the joints and enables the pressure loss in the gas header 4 to be reduced.

According to Embodiment 6, the first opening portion 18 between the bypass flow path and the refrigerant flow path partly overlaps, in the X-direction, the opening end portions of the flat pipes 3 that are inserted in the gas header 4.

With this structure, the refrigerant is likely to smoothly flow from the refrigerant flow path into the bypass flow path in the gas header 4 via the first opening portion 18. This enables the pressure loss in the gas header 4 to be reduced.

According to Embodiment 6, the second opening portion 8 between the bypass flow path and the refrigerant flow path overlaps, in the X-direction, at least the set of the joints that form the narrow gap.

With this structure, the second opening portion 8 enables the bypass for at least the refrigerant that flows through the set of the joints that form the narrow gap to be made, and the pressure loss of the refrigerant in the gas header 4 can be reduced.

Embodiment 7

<Structure of Heat Exchanger 100>

Figure 18:
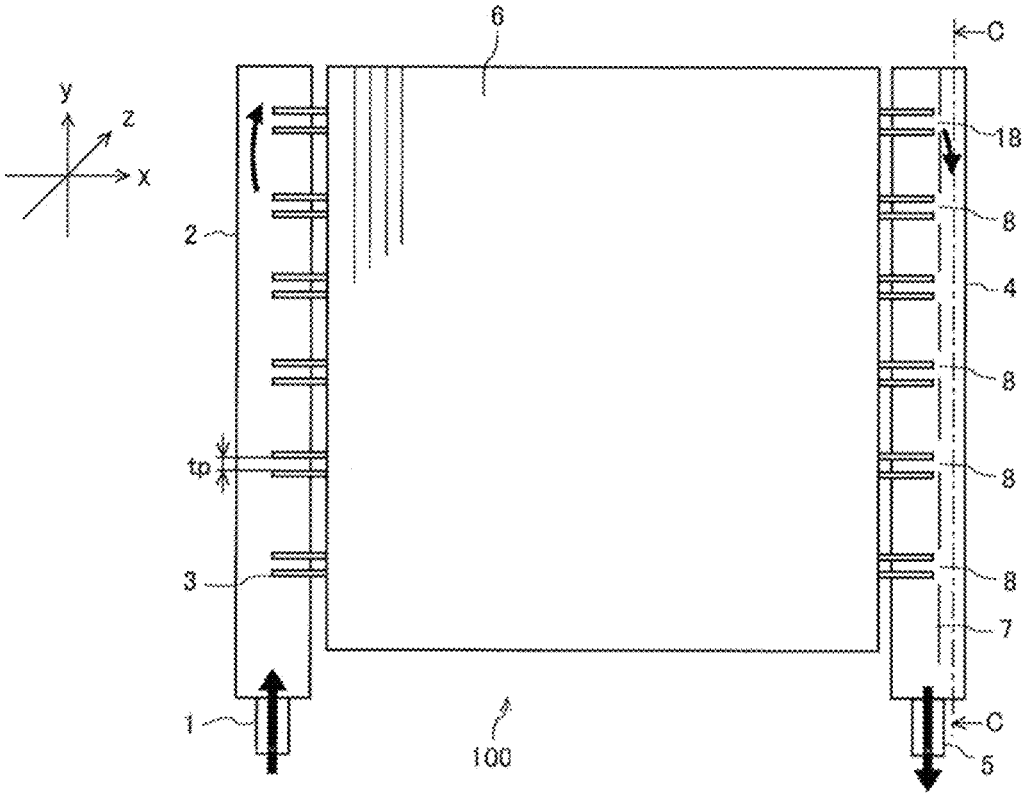
FIG. 18 schematically illustrates the structure of a heat exchanger according to Embodiment 7 of the present disclosure.
Figure 19:
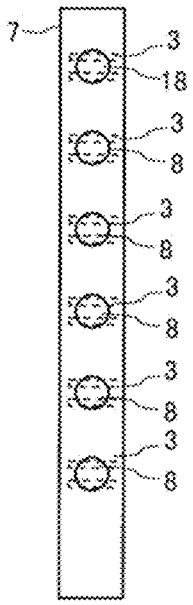
FIG. 19 illustrates a relationship between second opening portions of a gas header and flat pipes according to Embodiment 7 of the present disclosure taken along line C-C in FIG. 18.

FIG. 18 schematically illustrates the structure of a heat exchanger 100 according to Embodiment 7 of the present disclosure. FIG. 19 illustrates a relationship between second opening portions 8 of a gas header 4 and flat pipes 3 according to Embodiment 7 of the present disclosure taken along line C-C in FIG. 18. The same matters as those according to Embodiment 1, Embodiment 2, Embodiment 3, Embodiment 4, Embodiment 5, and Embodiment 6 described above are omitted, and only features according to Embodiment 7 will be described.

As illustrated in FIG. 18 and FIG. 19, the gas header 4 has the second opening portions 8. The flow of the refrigerant that passes through the joints of the flat pipes 3 can be further decreased by increasing the number of the second opening portions 8, and the pressure loss of the refrigerant in the gas header 4 can be reduced, which is good.

As illustrated in FIG. 19, the second opening portions 8 at least partly overlap the opening end portions of the flat pipes 3. This is good because the pressure loss of the refrigerant due to a collision between the partition 7 and the refrigerant can be reduced.

Embodiment 8

<Structure of Heat Exchanger 100>

Figure 20:
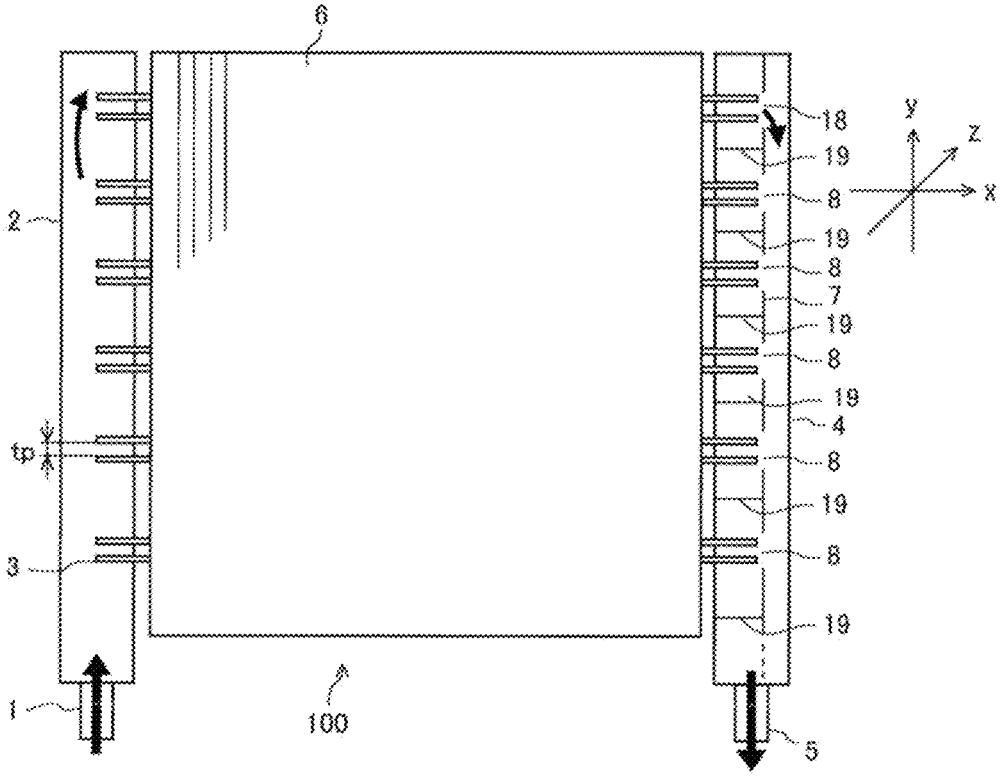
FIG. 20 schematically illustrates the structure of a heat exchanger according to Embodiment 8 of the present disclosure.

FIG. 20 schematically illustrates the structure of a heat exchanger 100 according to Embodiment 8 of the present disclosure. The same matters as those according to Embodiment 1, Embodiment 2, Embodiment 3, Embodiment 4, Embodiment 5, Embodiment 6, and Embodiment 7 described above are omitted, and only features according to Embodiment 8 will be described.

As illustrated in FIG. 20, the gas header 4 that has the second opening portions 8 contains the partition 7.

In addition to this, the gas header 4 contains at least one partition 19 near the joints of the flat pipes 3 in the gas header 4. Multiple partitions 19 described herein are disposed for respective sets of joints of two flat pipes 3 that are proximate to each other. That is, the gas header 4 is partitioned into at least one region for a set of the joints that form one of the narrow gaps.

This structure is good because the flow of the refrigerant that passes through the joints of the flat pipes 3 decreases, and the pressure loss of the refrigerant in the gas header 4 can be reduced.

Effects of Embodiment 8

According to Embodiment 8, the gas header 4 is partitioned into at least one region for the set of the joints that form the narrow gap.

With this structure, the refrigerant that passes through the joints that form the narrow gap can be separated in the partitioned gas header 4, and the pressure loss of the refrigerant in the gas header 4 can be reduced.

Embodiment 9

<Structure of Heat Exchanger 100>

Figure 21:
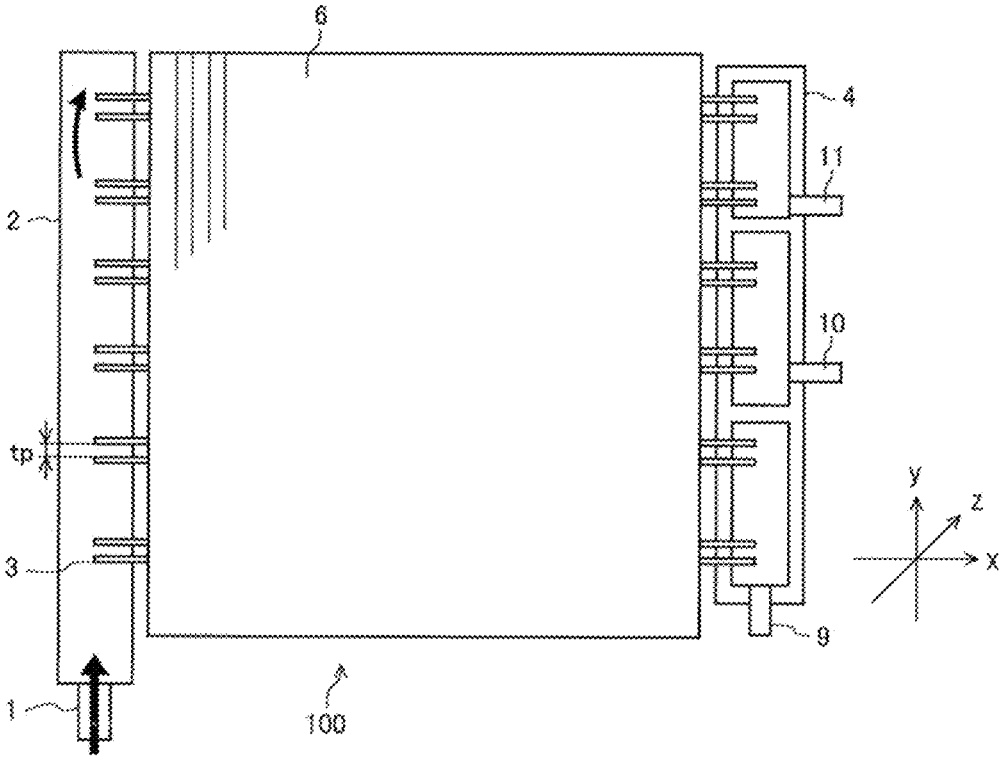
FIG. 21 schematically illustrates the structure of a heat exchanger according to Embodiment 9 of the present disclosure.

FIG. 21 schematically illustrates the structure of a heat exchanger 100 according to Embodiment 9 of the present disclosure. The same matters as those according to Embodiment 1, Embodiment 2, Embodiment 3, Embodiment 4, Embodiment 5, Embodiment 6, Embodiment 7, and Embodiment 8 described above are omitted, and only features according to Embodiment 9 will be described.

As illustrated in FIG. 21, the gas header 4 is divided into regions for some of the joints that form the narrow gaps. Outlet pipes 9, 10, and 11 are disposed on the respective flow paths that are divided in the gas header 4.

This structure is good because the flow of the refrigerant that passes through flat pipes 3 that are proximate to each other can be decreased, and the pressure loss of the refrigerant in the gas header 4 can be reduced.

<Other Structures of Heat Exchanger 100>

Figure 22:
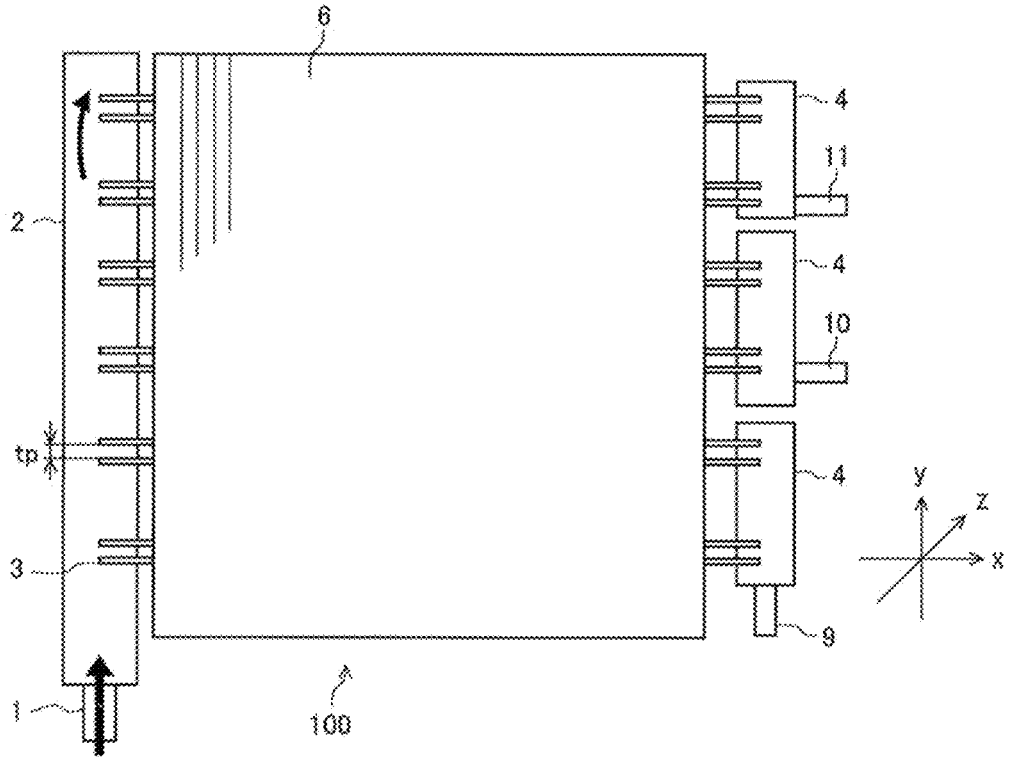
FIG. 22 schematically illustrates another example of the structure of the heat exchanger according to Embodiment 9 of the present disclosure.

FIG. 22 schematically illustrates another example of the structure of the heat exchanger 100 according to Embodiment 9 of the present disclosure. In FIG. 21, the gas header 4 is divided into three regions. As illustrated in FIG. 22, however, multiple gas headers 4 may merely have the respective divided regions.

Embodiment 10

<Refrigeration Cycle Apparatus 101>

Figure 23:
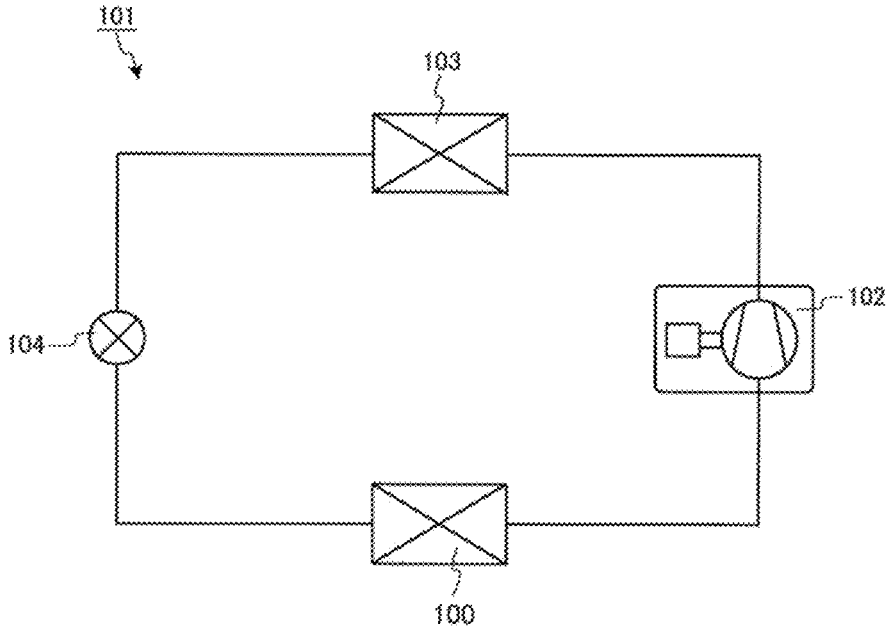
FIG. 23 is a refrigerant circuit diagram illustrating a refrigeration cycle apparatus that includes a heat exchanger according to Embodiment 10 of the present disclosure.
Figure 24:
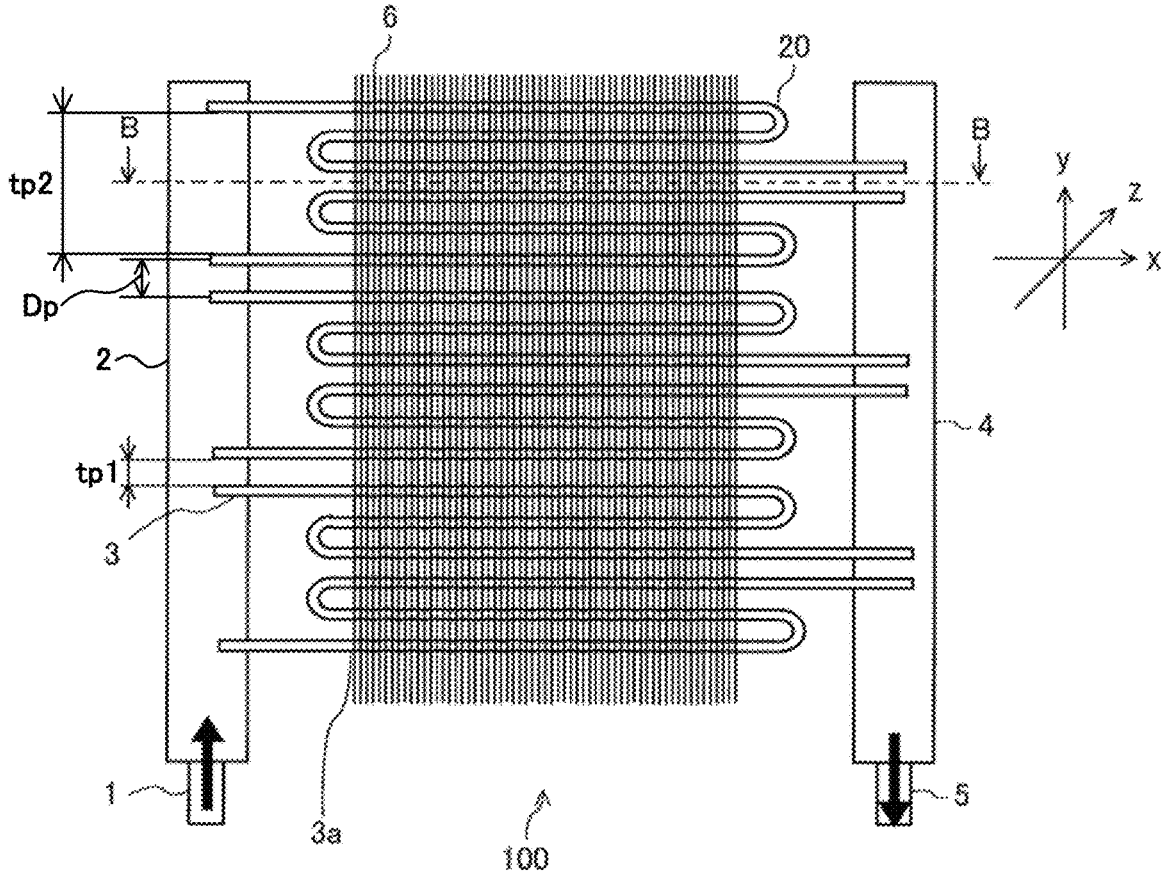
FIG. 24 schematically illustrates the structure of a heat exchanger.

FIG. 23 is a refrigerant circuit diagram illustrating the refrigeration cycle apparatus 101 that includes a heat exchanger 100 according to Embodiment 10 of the present disclosure.

As illustrated in FIG. 23, the refrigeration cycle apparatus 101 includes the compressor 102, a condenser 103, an expansion valve 104, and the heat exchanger 100 that serves as an evaporator. The compressor 102, the condenser 103, the expansion valve 104, and the heat exchanger 100 are connected by refrigerant pipes and form a refrigeration cycle circuit. The refrigerant that flows out from the heat exchanger 100 is sucked into the compressor 102 and turns into high-temperature and high-pressure refrigerant. The high-temperature and high-pressure refrigerant is condensed in the condenser 103 and liquefies. The liquid refrigerant is decompressed and expanded by the expansion valve 104 and turns into low-temperature, low-pressure, two-phase gas-liquid refrigerant. The two-phase gas-liquid refrigerant is used for heat exchange in the heat exchanger 100.

The heat exchangers 100 according to Embodiments 1 to 9 can be used for the refrigeration cycle apparatus 101. Examples of the refrigeration cycle apparatus 101 include an air-conditioning apparatus, a refrigeration apparatus, and a water heater.

Effects of Embodiment 10

According to Embodiment 10, the refrigeration cycle apparatus 101 includes the heat exchanger 100 described above.

With this structure, the refrigeration cycle apparatus 101 includes the heat exchanger 100, has a simple structure, and can reduce the pressure loss of the refrigerant.

Embodiments 1 to 10 of the present disclosure may be combined or may be used for another portion.

REFERENCE SIGNS LIST

1 inlet pipe, 2 refrigerant distributor, 3 flat pipe, 3*a* heat exchange portion, 4 gas header, 5 outlet pipe, 6 fin, 7 partition, 8 second opening portion, 9 outlet pipe, 10 outlet pipe, 11 outlet pipe, 15 vortex region, 16 distributor, 17 capillary tube, 18 first opening portion, 19 partition, 20 folded portion, 100 heat exchanger, 101 refrigeration cycle apparatus, 102 compressor, 103 condenser, 104 expansion valve.

The invention claimed is:

1. A heat exchanger comprising:

a plurality of flat pipes in which two-phase gas-liquid refrigerant flows and turns into gas refrigerant by being heated from a location outside the plurality of flat pipes; and a gas header in which the gas refrigerant flowing out from the plurality of flat pipes is collected, the gas header being connected to first end portions of the plurality of flat pipes, wherein the gas header longitudinally extends in a Y-direction such that the refrigerant flows in the Y-direction, the plurality of flat pipes are spaced from each other in the Y-direction, respective ends of the flat pipes have a plurality of joints, which serve to allow the flat pipes to be inserted into the gas header in an X-direction, and gaps between the plurality of joints include a narrow gap and a wide gap, where the X-direction and the Y-direction are directions perpendicular to each other in a space, the joints forming the narrow gap are included in a group of two or more flat pipes of the flat pipes, the group of the two or more flat pipes in which the joints form the narrow gap being symmetrical about an imaginary center line that extends in the X-direction at the center of the group in the Y-direction, and each of the flat pipes in the group of two or more flat pipes that are symmetrical about the imaginary center line has folded portions that are obtained by folding the end portions in a direction in which the end portions are away from the imaginary center line.

2. The heat exchanger of claim 1, further comprising: a plurality of fins connected to the plurality of flat pipes in heat exchange portions other than the joints, the plurality of flat pipes are equally spaced in the Y-direction in the heat exchange portions;

wherein the gaps between the plurality of joints satisfy $tp1<Dp$ and $tp2>2\times Dp$, where tp1 is a length of a minimum gap, tp2 is a length of a maximum gap, and Dp is a step pitch that is a distance between the centers of minor axes of adjacent flat pipes of the plurality of flat pipes in the heat exchange portions.

3. The heat exchanger of claim 1, wherein heat exchange portions of the plurality of flat pipes other than the plurality of joints and the folded portions are equally spaced from each other in the Y-direction.

4. The heat exchanger of claim 1, wherein the gas header contains a partition and has a bypass flow path.

5. The heat exchanger of claim 4, wherein a first opening portion between the bypass flow path and a refrigerant flow path partly overlaps, in the X-direction, opening end portions of the plurality of flat pipes inserted in the gas header.

6. The heat exchanger of claim 4, wherein a second opening portion between the bypass flow path and a refrigerant flow path overlaps, in the X-direction, at least one set of the joints forming the narrow gap.

7. The heat exchanger of claim 1, further comprising a refrigerant distributor connected to second end portions of the plurality of flat pipes and configured to distribute the two-phase gas-liquid refrigerant to the plurality of flat pipes.

8. The heat exchanger of claim 1, wherein the gas header is partitioned into at least one region for the joints forming the narrow gap.

9. A refrigeration cycle apparatus comprising the heat exchanger of claim 1.

10. The heat exchanger of claim 1, wherein a number of the folded portions of each flat pipe increases as a distance from the flat pipe to an outlet port of the gas header decreases.

* * * * *